US006185914B1

(12) United States Patent
Mackie

(10) Patent No.: US 6,185,914 B1
(45) Date of Patent: Feb. 13, 2001

(54) PRE-STRETCH WEB DISPENSER

(75) Inventor: Laurie Robert Mackie, Oshawa (CA)

(73) Assignee: 1137508 Ontario Ltd., Scarborough (CA)

( * ) Notice: Under 35 U.S.C. 154(b), the term of this patent shall be extended for 0 days.

(21) Appl. No.: 09/393,310

(22) Filed: Sep. 10, 1999

(51) Int. Cl.[7] ..... B65B 53/00
(52) U.S. Cl. ..... 53/556; 53/587
(58) Field of Search ..... 425/66; 53/556, 53/587, 441

(56) References Cited

U.S. PATENT DOCUMENTS

| | | | |
|---|---|---|---|
| 4,302,920 | 12/1981 | Lancaster et al. | 53/399 |
| 4,458,467 | 7/1984 | Shulman et al. | 53/399 |
| 4,497,159 | 2/1985 | Lancaster, III | 53/556 |
| 4,706,443 | 11/1987 | Humphrey | 53/556 |
| 4,718,219 | 1/1988 | Schmitz | 53/556 |
| 4,841,716 | 6/1989 | Roymberg | 53/556 |
| 5,836,140 * | 11/1998 | Lancaster | 53/556 |

* cited by examiner

*Primary Examiner*—Linda Johnson
(74) *Attorney, Agent, or Firm*—John R. S. Orange; Orange & Chari

(57) ABSTRACT

A pre-stretch wrapping device consisting of a base, a pre-stretch station, a vertical drive, and a rotatable load causes a pre-stretched web to become wrapped around the load under controlled tension. The pre-stretch station comprises a pair of pre-stretch rollers located on a pivotal frame, a spring which opposes the pivotal movement of the frame relative to the base, a roller motor, and a sensor located between the frame and the base. The sensor monitors relative movement of the frame from the base and a controller in response to signals from the sensor controls the operation of the roller motor.

12 Claims, 3 Drawing Sheets

PRE-STRETCH WEB DISPENSER

This invention relates to a device and process for applying a plastic wrap to an article.

BACKGROUND OF THE INVENTION

The transportation of multiple sacks or boxes is commonly simplified by stacking them in an ordered manner on a platform, usually referred to as a pallet. This pallet, normally made of wood or plastic, can then be lifted and carried by a forklift and thereby stored in a warehouse or placed in a mobile transport, such as cargo ships or trucks. Such loading and transport arrangements can undesirably result in knocking the sacks or boxes off their pallet. In order to stabilize the load on the pallet, a film or web is commonly wrapped around the stacked items. It is desirable to pre-stretch this web past its elastic limit during the wrapping operation, in order to bind the pallet load as tightly as possible.

There are numerous prior art packaging devices available to generate the forces required to stretch and wrap a plastic web around an arbitrarily shaped pallet load. The more recent devices, such as U.S. Pat. Nos. 4,458,467 and 4,706,443, use a set of pre-stretch rollers which stretch the plastic web by a predetermined amount without putting an excessive or uneven horizontal destabilizing force on the pallet load. The tension of the prestretched web is controlled by monitoring movement of the idler rollers. The pre-stretch process also has the added benefit of smoothing out any unnecessary wrinkles present in the feedstock wrapping material.

One disadvantage of this wrapping process is the tension on the pre-stretched wrapping material does not usually remain constant while it is being applied to the pallet load. The exterior load surface is typically at varying radial distance from the load center and the load rotates in an eccentric manner because of unavoidable inexact centering on the turntable. The resulting variability in wrapping tension may produce tight and loose regions in the wrap, which can cause the wrapped load to be become unstable. There is a need to retain a predetermined web tension during wrapping so as to bind the load tightly, but the nature of the load results in a need for adjusting the web speed.

The two above mentioned prior art devices compensate for the variability in web tension by changing the speed of the roller-motor through a feedback sensor and controller system. This is accomplished in the case of 4,458,467 through the use of two idler rollers and a position transducer, which senses excessive rotational displacement of the idler assembly from its biased position. Reduction of one idler roller was accomplished by 4,706,443 but with the added consequence of a more complicated position sensor arrangement.

The use of idler rollers for feedback control compensates for the problem of variable pre-stretched web tension, but also increases the tortuosity of the path the fragile web must travel from the pre-stretch rollers to the pallet load. This increases the risk of damage to the thin pre-stretched web during the wrapping operation, which normally takes place in an industrial environment. The increase in path length for the pre-stretched web also allows the applied pre-stretch additional recovery time, which is not desirable because either the web must be over-stretched to compensate for the recovery period, or the binding strength of the wrapped web around the pallet load can be less than optimal. An additional complication is the increase in the size of the packaging device's footprint, which is undesirable in small spaces and high traffic areas. One further disadvantage of employing idler rollers to control web tension is the increased weight of the pre-stretch assembly, which must be raised and lowered throughout the wrapping operation by mechanized means.

It is an object of the present invention to obviate or mitigate the above problems.

SUMMARY OF THE INVENTION

In one aspect of the invention, there is provided a web dispenser for dispensing a web of flexible packaging material. The dispenser comprises a base, a holder to support a roll of the packaging material and permitted to be dispensed as a continuous web therefrom and a pre-stretch station to elongate the web deliver it to a load to be wrapped. The pre-stretch station comprises a frame, at least one roller mounted on the frame, a drive mechanism to rotate the roller, and a sensor responsive to the displacement of the roller relative to the base, due to variations in load applied by the web to the roller. A control system controls the operation of the drive in response to signals received from the sensor; in order to retain the web tension at a predetermined set value. The web dispenser further comprises a driven turntable to support and rotate the load and entrain the web around the load. The pre-stretch station is moveable along a vertical axis relative to the base.

The pre stretch station includes a pair of rollers of different diameter mounted on the frame. The packaging material is unwound from the feed stock roll, entrained around the rollers, and then subsequently wrapped around the rotating load. The rollers are mounted on the frame of the pre-stretch station and the frame is pivotally connected to the base, whereby variations in the load applied by the web to the roller causes pivotal movement of the frame. An adjustable spring opposes this pivotal movement, which is monitored by the sensor positioned between the frame and the base.

BRIEF DESCRIPTION OF THE DRAWINGS

An embodiment of the invention will now be described by way of example only, with reference to the accompanying drawings in which.

DESCRIPTION OF THE PREFERRED EMBODIMENT

Figure 1:
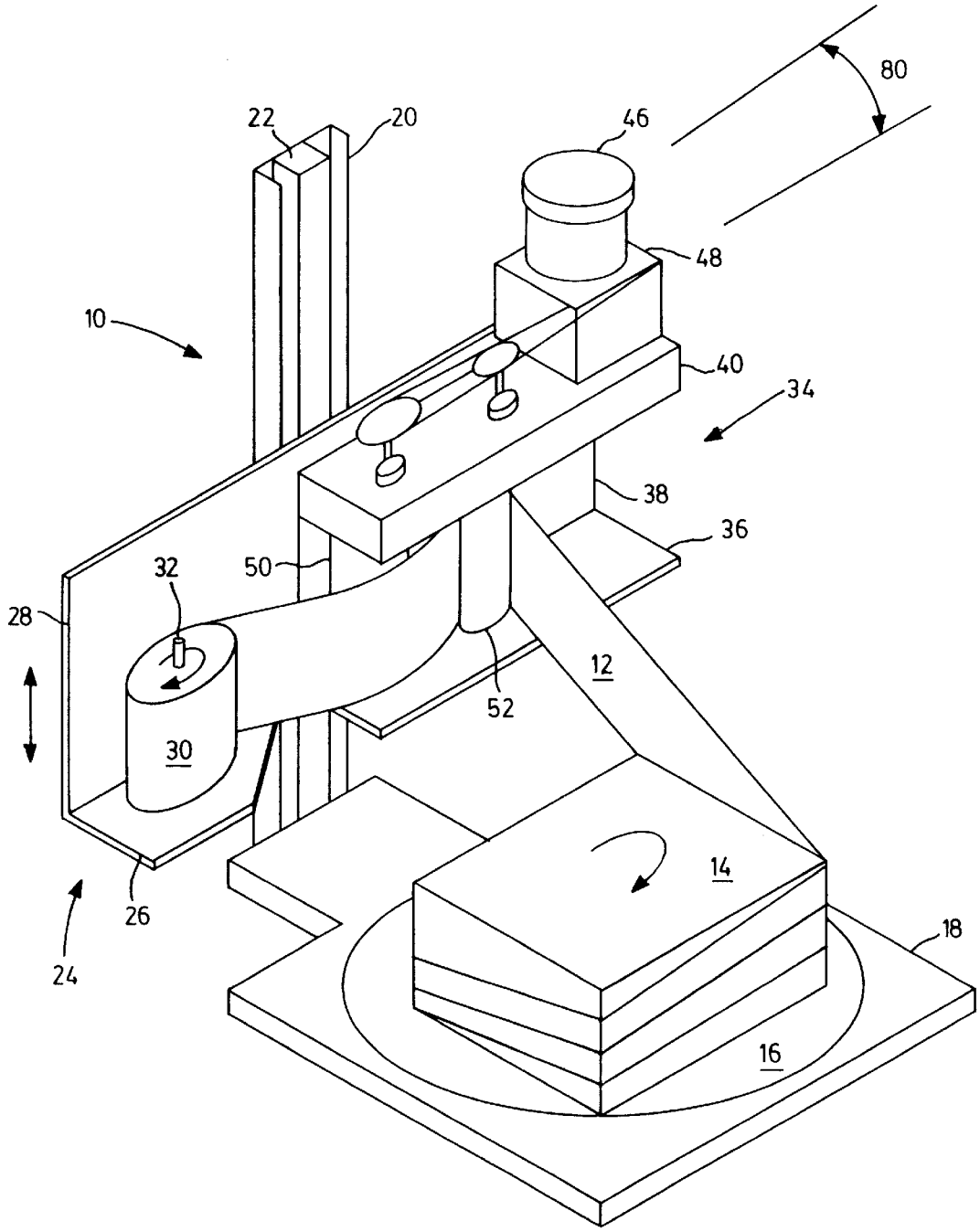
FIG. 1 is a perspective view of a stretch packaging device.

As seen in FIG. 1, an automated pre-stretch packaging device 10 pre-stretches wrapping material from a feedstock roll 30 and subsequently applies a web 12 to an arbitrarily shaped pallet load 14. The load 14 is situated somewhat centrally on a rotatable turntable 16, which is supported by a stable base 18, including a vertical tower 20 which encloses a screw-drive 22. Firmly fastened to the screw-drive is a carriage 24, composed of a vertical backplate 28 and horizontal base 26. The screw-drive 22 is responsible for raising and lowering the carriage 24, by motorized means, during the wrapping process. The feedstock roll 30 of web 12 is positioned on a mandrel 32, which is securely attached to the base 26. A roller-motor 46 is secured by bolts to a motor mount 48, which is firmly attached to a pre-stretch pivot assembly 34. The pivot assembly 34 comprises a horizontal base 36, a vertical plate 38, and a rectangular box 40 fastened to a top of the plate 38. Situated in the pre-stretch pivot assembly 34 are a primary pre-stretch roller 50 and a secondary pre-stretch roller 52. The diameter of the secondary roller 52 is greater than that of the primary 50 roller, so as to provide the desired degree of pre-stretch to the web 12.

Figure 2:
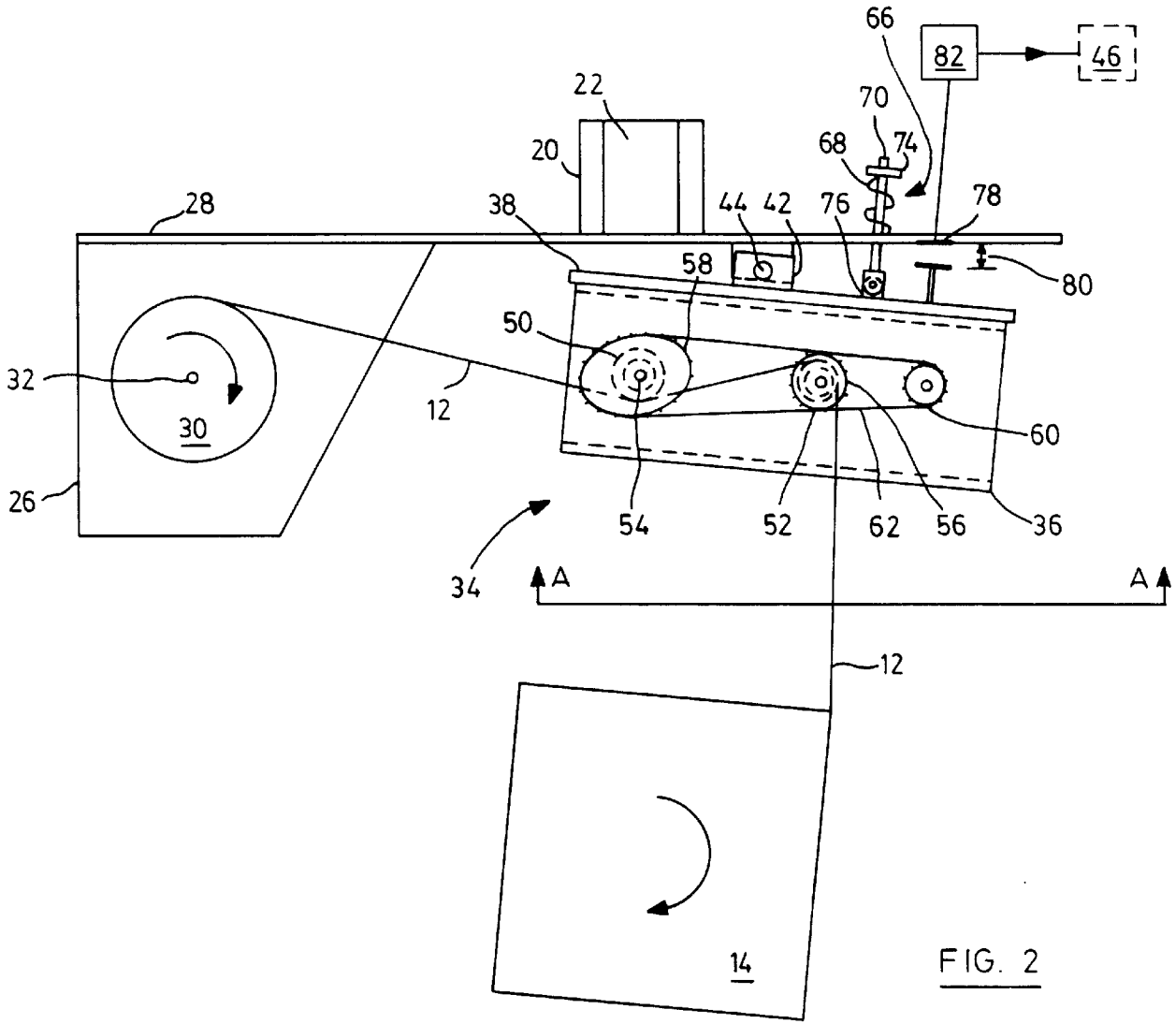
FIG. 2 is a top view of the device shown in FIG. 1.
Figure 3:
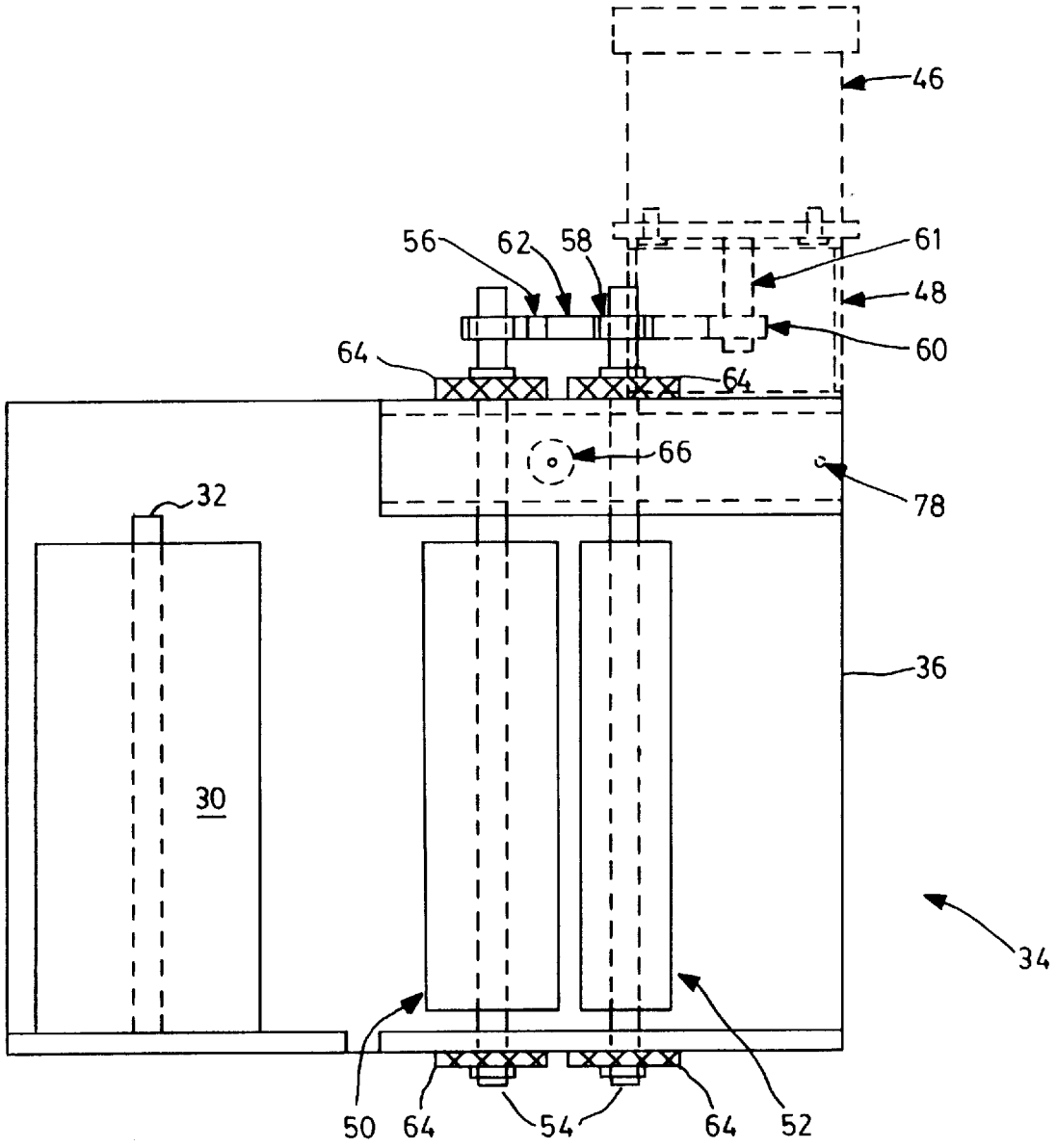
FIG. 3 is a side view in direction of A arrow in FIG. 2.

As seen in FIG. 2, the plate 38 of the pre-stretch pivot assembly 34 is attached to the carriage backplate 28 by two pinned joints 42, to permit limited pivotal movement of the pre-stretch pivot assembly 34 about a central axis 44. shown in FIGS. 2 and 3, the primary roller 50 and secondary roller 52 are positioned vertically on respective rotatable shafts 54 in the pre-stretch pivot assembly 34. The two pre-stretch rollers 50, 52 are surfaced with a non-slip material, such as smooth rubber, which provides adequate frictional engagement with the wrapping material 12. The secondary pre-stretch roller 52 has a diameter greater than that of the primary roller 50, where the preferred diameter ratio is 4:3. The rollers 50, 52 are releasably secured if other diameter ratios are desired.

A primary and a secondary pre-stretch roller sprocket, 56 and 58 respectively, are fastened securely at a top of their corresponding shafts 54. These sprockets 56, 58 are linked to a drive sprocket 60 by a drive chain 62. As seen in FIG. 3, the drive sprocket 60 is connected to the roller-motor 46 by a drive shaft 61. The pre-stretch roller shafts 54 are supported at either end by two corresponding sets of bearings 64, which are fastened securely to a top of the rectangular box 40 and a bottom of the pre-stretch pivot base 36.

Pivotal movement of the pre-stretch pivot assembly 34, illustrated in FIG. 2, is resisted by a spring mechanism 66. The spring mechanism 66 consists of a spring 68 positioned along a rod 70. The spring 68 is sandwiched between the vertical backplate 28 and a tension adjustment knob 74. The rod 70 is fastened securely at one end by a pinned joint 76 connected to the carriage backplate 28. A force generated by the spring assembly 66 is biased to position the pre-stretch pivot assembly 34 generally parallel to the carriage backplate 28.

The feedback control of the roller-motor 46 is regulated by an electromechanical position transducer 78, typically a proximity device. The transducer 78 produces an analog signal, which is proportional to an offset distance 80 between the carriage backplate 28 and the pre-stretch pivot assembly 34. The analog signal from the transducer 78 provides input to a feedback control circuit 82, known to the art, and the control circuit 82 in turn is used to adjust the speed of the roller-motor 46.

The operation of the feedback controlled pre-stretch web-packaging device 10 is now described in greater detail with reference to FIGS. 1 and 2. The web 12 is initially threaded from the feedstock roll 30 through the pre-stretch rollers 50, 52 to the pallet load 14. The carriage 24 is situated at the bottom of the tower 20. A turntable motor, not shown, drives the turntable 16, which allows the pre-stretched web 12 to be spirally wrapped around the exterior surface of the pallet load 14 as the carriage 24 is raised by the screw-drive 22. As the load 14 on the turntable 16, the web 12 is drawn off the feedstock roll 30 and pre-stretched by the differential surface speed of the two pre-stretch rollers 50, 52, which are driven by the roller-motor 46. The rotation of the load 14 maintains tension of the web 12 between the load 14 and the secondary pre-stretch roller 52. If the wrapping tension becomes excessive, the pre-stretch pivot assembly 34 pivots about the pins 42 and the offset distance 80 measured by the position transducer 78 increases, shown in FIG. 3. This increased offset 80 prompts the control circuit 82 to increase the speed of the roller-motor 46 by a corresponding predetermined amount, which thereby relieves the excess tension in the pre-stretched web 12. On the contrary if the tension of the pre-stretched web 12 becomes too low, the pre-stretch pivot assembly 34 moves towards its initial position under the influence of the spring 68. The offset distance 80 is thereby decreased, and the control circuit 82 acts to correspondingly decrease the speed of the roller-motor 46. In this manner the tension in the web is maintained within preset limits.

The mounting of the rollers on the pivotal base 36 permits a direct measurement of variations in the load applied to the web 12 and therefore simplifies the path of the web 12 and components of the wrapping device 10. Whilst a mechanical spring 68 is shown, it will be appreciated that other biasing devices, such as air springs may be utilized and that alternative forms of measuring devices may be incorporated. Similarly, the drive connection between the rollers 50, 52 and the motor 46 may be implemented in other ways to achieve the differential drive. A method other than the screw drive 22, such as a chain drive, can be employed to control the vertical position of the pre-stretch station 34.

Although the invention has been described with reference to certain specific embodiments, various modifications thereof will be apparent to those skilled in the art without departing from the spirit and scope of the invention as outlined in the claims appended hereto.

The embodiments of the invention in which an exclusive property or privilege is claimed are defined as follows:

1. A web dispenser for dispensing a web of flexible packaging material; said dispenser comprising a base, a holder to support a roll of said packaging material and permit it to be dispensed as a continuous web therefrom, a pre-stretch station to elongate said web and deliver it to a load to be wrapped; said pre-stretch station comprising a frame, at least one roller mounted on said frame, a drive mechanism to rotate said roller, and a sensor responsive to displacement of said roller relative to said base due to variations in load applied by said web to said roller; and a control system controlling the operation of said drive in response to signals received from said sensor to retain said web tension at a predetermined set value.

2. A web dispenser as set forth in claim 1 further comprising a driven turntable to support and rotate said load and entrain said web around said load.

3. A web dispenser as set forth in claim 1, wherein said pre-stretch station is moveable along a vertical axis relative to said base.

4. A web dispenser as set forth in claim 1, wherein said drive mechanism comprises a motor mounted on said frame and operably connected to said roller to cause rotation thereof.

5. A web dispenser as set forth in claim 1, wherein said controller varies the speed of said drive mechanism in proportion to said relative displacement between said roller and said base detected by said sensor.

6. A web dispenser as set forth in claim 1, wherein said pre-stretch station includes a pair of rollers of different diameter mounted on said frame, and said web is entrained around said rollers.

7. A web dispenser according to claim 6, wherein said rollers are mounted on said frame and said frame is pivotally connected to said base, whereby variations in load applied by said web to said roller cause pivotal movement of said frame.

8. A web dispenser according to claim 7, wherein a spring opposes pivotal movement of said frame relative to said base.

9. A web dispenser according to claim 8, wherein said spring is adjustable.

10. A web dispenser according to claim 7, wherein said sensor is positioned between said frame and a carriage backplate to monitor relative pivotal movement there between.

11. A web dispenser according to claim 7, wherein said rollers are operably connected for conjoint rotation and a motor is mounted on said frame and operably connected to one of said rollers.

12. A web dispenser according to claim 11, wherein said rollers are operably connected by a chain drive.

* * * * *